United States Patent [19]
Daimler et al.
[11] 3,934,421
[45] Jan. 27, 1976

[54] GROUND STABILIZATION MATTING

[75] Inventors: Berthold H. Daimler, Remscheid-Lennep, Germany; Jan Vos, Dieren, Netherlands; Wilhelm Herveling, Wuppertal, Germany

[73] Assignee: Akzona Incorporated, Asheville, N.C.

[22] Filed: Aug. 2, 1974

[21] Appl. No.: 494,157

Related U.S. Application Data

[63] Continuation of Ser. No. 315,454, Dec. 15, 1972, abandoned.

[52] U.S. Cl. ..... 61/35; 61/38; 161/70; 273/29; 404/70

[51] Int. Cl.[2] ..... E02D 3/08; D01D 5/22

[58] Field of Search ..... 404/17, 35, 31, 44, 70; 273/29, 198, 176 J, 178 B, 195 A, 195 R; 161/70, 72, 150, 177, 7; 61/37, 38, 35, 50

[56] References Cited

UNITED STATES PATENTS

| | | | |
|---|---|---|---|
| 3,630,816 | 12/1971 | Parker | 161/150 |
| 3,670,506 | 6/1972 | Gaudard | 404/17 |
| 3,691,004 | 9/1972 | Werner et al. | 161/166 |

*Primary Examiner*—Jacob Shapiro
*Attorney, Agent, or Firm*—Francis W. Young; Tom R. Vestal

[57] ABSTRACT

A matting comprised of a plurality of continuous amorphous synthetic thermoplastic filaments having an equivalent diameter of about 0.1 to 2.0 millimeters is disclosed to be used for the ground stabilization of road beds. The filaments comprising the matting are arranged in a number of superimposed contacting rows with an overlapping intersection of the loops of adjacent filaments in at least the same row with superficial bonding of the filaments at their points of intersection.

8 Claims, No Drawings

GROUND STABILIZATION MATTING

This is a continuation of application Ser. No. 315,454, filed Dec. 15, 1972, now abandoned.

In certain terrains ground structure conditions have a tendency to become unsuitable for bearing loads of any degree. For example, the sandy surface found along most beaches can be difficult. The ability and readiness with which the grains of sand displace each other cause vehicles and pedestrians to sink into the sand when driving or walking on the sandy ground.

Soils with large clay content tend to shift laterally under the weight of vehicles or pedestrians when wet; and, in a short period of use, travel through the wet clay soil becomes almost impossible except with special vehicles designed for such conditions. It is the object of this invention to alleviate or eliminate the above conditions through the use of mechanical soil stabilization devices. U.S. Pat. No. 3,691,004 describes an elastic matting comprised of a number of looped, intersecting, large amorphous filaments of melt-spun synthetic polymers, the filaments cohering to each other at their points of intersection. In general, the loops are proportionately large and provide a very open structure in the matting. Adjacent filamentary loops overlap one another, and the finest diameter filaments should contain loops which extend for at least 1 mm and preferably 2mm or more, the larger filaments normally extending to a much greater degree. As a rule, the loop extension should be at least 10 times the individual filament diameter. The upper limit of this loop extension is preferably adjusted so that the overlapping between adjacent filaments is just sufficient to ensure adequate bonding at random points of intersection. It has been found that the use of the matting of the above disclosure increases considerably the load carrying capacity of soils with the above described conditions.

For present purposes, "clay" shall mean any of the plastic, soft, variously colored earths, formed generally by decomposition of the aluminum minerals; "sand" shall mean generally a natural aggregation of mineral matter, i.e. rock, that has undergone weathering and disintegration; "loose soil strata" shall mean said strata exposed to or near the soil surface, and normally incapable of sustaining heavy and/or repeated loads of a generally vertical nature. "Compatible soil" shall mean any soil capable of being mixed with the loose soil strata without deleterious effects.

The means in which the matting is incorporated into the soil is twofold. First, the matting may be laid in a flattened condition upon the soil in such a manner that traffic is directed over the matting. After a period of time, the travel conditions will cause the matting to work into the soil and largely disappear below the surface of the soil. In doing so, the matting fills up with the soil material until it is practically compactly filled. The looped structures of the matting tend to prevent lateral shifting of the soil particles so that the surface effect in the soil is to impart a substantial feeling to the soil and permit it to withstand comparatively strong elastic and/or dynamic loading.

Secondly, the matting may be laid out on the ground and filled with a suitable mixture of soil, clay, sand, etc., before the application of any load. In both instances, the matting will act as a weight distributing substructure. It has been found that the matting disclosed above can be used to reinforce roadbeds, runways, foundation areas for light buildings, and pedestrian paths along beaches and sand dunes.

In roadbeds of high natural moisture content, the matting may be used underneath the road structure for drainage purposes. In such instances, the matting is placed across the roadbed with at least one extension of the matting leading to an appropriate drainage area. The matting is then filled with a fine grannular sand and the road structure is constructed with otherwise conventional techniques. Excess moisture will now be drained from the surrounding roadbed into the porous matting structure and subsequently to the drainage area. The matting constructed in accordance with the above will have as great or greater vetical load capacity than the surrounding roadbed.

The advantage of using matting as in the above disclosure over conventional soil stabilizing techniques utilizing lime, cement, or other hardenable binders is that it has a very good permeability. Moreover, it permits the quick preparation of passable surfaces, which is important when installing emergency roads, paths or runways.

It has been found that filaments of a non-round, cross-section have a greater lateral load bearing capacity than round cross-section filaments. This is evidently caused by the surface area of each filament presented to the soil contained therein inhibiting lateral movement. Filaments that have an exceptionally large length to width ratio have a tendency to be difficult to fill with soil. For purposes of this invention cross-sections with an axis of symmetry in the range of 2 to 10 appear quite satisfactory.

The thickness of the matting may vary with the load requirement. A pedestrian walkway on a sandy beach may be as thin as 3 centimeters, while matting for heavy vehicular traffic may require a thickness of 25 centimeters. Use of non-round, cross-section filaments may reduce this thickness, however, by two-thirds. A matting of non-round, cross-section filaments with a thickness of 5 to 8 centimeters has been found to be a multipurpose matting in most instances for both pedestrian and vehicular traffic.

EXAMPLE 1

A pipe with an inside diameter of 35 millimeters and having a surface contact area of roughly 2.94 square centimeters was placed in a vertical position on a layer of sand of 7 centimeters thickness. The grain size of the sand was from size 0 to 3 millimeters. Under a load of 3 kilograms, the pipe sank until it encountered a resistance below the layer of sand.

A matting comprising melt-spun polyamide filaments of an equivalent diameter of 0.01 to 2.0 millimeters and whose filaments were looped and bonded to the adjacent filaments at their points of intersections was filled with a similar sand. The thickness of the matting was 6 centimeters. A pipe of similar dimensions was placed upright on the sand-filled matting and a load was applied to the pipe in a downward direction. The load was increased to 80 kilograms before any perceptible deformation of the surface could be observed.

EXAMPLE 2

An elastic matting of the thickness of 8 centimeters made of polyamide filaments of a diameter of 1.1 millimeters was laid out on a layer of sand of a grain size of 0 to 3 millimeters. The matting was filled with a similar grain size sand. This reinforced layer of sand was subjected to a dynamic vehicular load of 1500 kilograms. The reinforced layer of sand was repeatedly driven on with no perceptible surface deformation.

What is claimed is:

1. A vertical load bearing structure comprising the combination of a matting of looped, intersecting interbonded synthetic polymer filaments, and a compatible soil contained in the matting, said filament loops being at least one millimeter in diameter and having a loop extension of at least 10 times the individual filament diameter, the combination of matting and compatible soil having increased vertical load bearing capacity and resistance to lateral shifting over the individual elements of the combination.

2. The vertical load bearing soil structure of claim 1 wherein said compatible soil is selected from the group consisting of clay, sand, and loose soil strata.

3. The vertical load bearing structure of claim 1 wherein the compositon of said compatible soil is predominately clay.

4. The vertical load bearing structure of claim 3 wherein the compatible soil is sand.

5. The vertical load bearing soil structure of claim 1 wherein said matting has a thickness of 3 to 25 centimeters.

6. The vertical load bearing soil structure of claim 5 wherein said matting has a thickness of 5 to 8 centimeters.

7. The vertical load bearing soil structure of claim 1 wherein said matting is made of polyamide continuous filaments of an equivalent diameter of 0.1 to 2.0 millimeters.

8. The vertical load bearing soil structure of claim 1 wherein said synthetic polymer filaments are of a nonround, cross-section with an axis of symmetry between 2 and 10.

* * * * *